US007014924B2

(12) United States Patent
Koyama et al.

(10) Patent No.: US 7,014,924 B2
(45) Date of Patent: Mar. 21, 2006

(54) METAL MEMBER TO BE CAST-WRAPPED

(75) Inventors: Yoshiaki Koyama, Wako (JP); Mitsunori Arimura, Wako (JP); Kaoru Mitsuuchi, Wako (JP); Toshiyuki Shibasaki, Wako (JP); Yoshiaki Itou, Itami (JP); Ryuji Shiga, Itami (JP); Kouji Yamada, Itami (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 45 days.

(21) Appl. No.: 10/069,976

(22) PCT Filed: Jun. 15, 2001

(86) PCT No.: PCT/JP01/05141

§ 371 (c)(1),
(2), (4) Date: Mar. 12, 2002

(87) PCT Pub. No.: WO02/04150

PCT Pub. Date: Jan. 17, 2002

(65) Prior Publication Data

US 2002/0134128 A1 Sep. 26, 2002

(30) Foreign Application Priority Data

Jul. 12, 2000 (JP) ..... 2000-211747

(51) Int. Cl.

| | |
|---|---|
| ***B32B 3/00*** | (2006.01) |
| ***B32B 15/00*** | (2006.01) |
| ***B21C 37/00*** | (2006.01) |
| ***B21C 37/06*** | (2006.01) |

(52) U.S. Cl. ..... 428/687; 428/609; 428/573; 428/577; 428/582; 164/111

(58) Field of Classification Search ..... 403/265, 403/267; 164/111; 428/609, 573, 574, 577, 428/580, 582, 583, 586, 687, 612, 654
See application file for complete search history.

(56) References Cited

U.S. PATENT DOCUMENTS

| | | | | |
|---|---|---|---|---|
| 4,154,900 A | * | 5/1979 | Kaku et al. | 428/554 |
| 4,576,875 A | * | 3/1986 | Olsson et al. | 428/627 |
| 6,050,323 A | * | 4/2000 | Soell et al. | 164/95 |
| 6,074,763 A | | 6/2000 | Rueckert et al. | 428/577 |

FOREIGN PATENT DOCUMENTS

| | | |
|---|---|---|
| JP | 49-44857 | 11/1974 |
| JP | 49-044857 | * 11/1974 |
| JP | 53-099040 | 8/1978 |
| JP | 01-317679 | * 12/1988 |
| JP | 1-317679 | 12/1989 |
| JP | 08-290255 | 11/1996 |
| JP | 10-94867 | 4/1998 |

* cited by examiner

*Primary Examiner*—Michael E. Lavilla
(74) *Attorney, Agent, or Firm*—Armstrong, Kratz, Quintos, Hanson & Brooks, LLP

(57) ABSTRACT

A metal member to be cast-wrapped by a metal cast article, a manufacturing method thereof and a metal cast article including the metal member cast-wrapped are provided. A hollow cylindrical metal member having an outer surface with projections to be cast-wrapped by a metal cast article is manufactured in such a manner that a hollow cylindrical metal raw material 13 is inserted in a die 17 having a inner peripheral surface with longitudinal grooves of a depth H and a width W, and the hollow cylindrical metal raw material 13 is subjected to hot-extrusion.

11 Claims, 10 Drawing Sheets

1-a
RAPID COOLING, SOLIDIFICATION
1
2
3
4
4
5

1-b
MIXING
6
7
8

1-c
C I P(COLD HYDROSTATIC PRESSURE PRESS)
8
9
10
11
11
12

1-d
13

1-e
PRE-HEATING, DEGASSING
13

1-f
HOT EXTRUSION
13
14
15
16
16
17
18
X 1-g
CUTTING, MECHANICAL WORKING
19

Fig.5

| No. | DEPTH H | WIDTH W | DEPTH/WIDTH H/W | SPAN θ | PERIPHERAL LENGTH L | PERIPHERAL LENGTH RAITO L/d, π | INNER DIAMETER d | SHAPE | TEAR PRODUCING RATE |
|---|---|---|---|---|---|---|---|---|---|
| EMBODIMENT1 | | | | | | | | | |
| SAMPLE1 | 1 | 0.38 | 2.7 | 1.5 | 776.3 | 2.62 | 94.3 | | 95 |
| SAMPLE2 | 0.7 | 0.38 | 1.9 | 1.5 | 632.3 | 2.13 | 94.3 | | 92 |
| SAMPLE3 | 0.5 | 0.38 | 1.3 | 1.5 | 536.3 | 1.81 | 94.3 | | 59 |
| SAMPLE4 | 0.3 | 0.38 | 0.8 | 1.5 | 440.9 | 1.49 | 94.3 | | 11 |
| SAMPLE5 | 0.2 | 0.38 | 0.5 | 1.5 | 392.3 | 1.32 | 94.3 | | 0 |
| | | | | | | | | | |
| EMBODIMENT2 | | | | | | | | | |
| SAMPLE6 | 1 | 0.38 | 2.7 | 1.5 | 776.3 | 2.62 | 94.3 | | 95 |
| SAMPLE7 | 1.3 | 0.50 | 2.7 | 2.0 | 776.3 | 2.62 | 94.3 | | 93 |
| SAMPLE8 | 2.7 | 1.00 | 2.7 | 4.0 | 776.3 | 2.62 | 94.3 | | 88 |
| SAMPLE9 | 3.5 | 1.30 | 2.7 | 5.2 | 776.3 | 2.62 | 94.3 | | 71 |
| SAMPLE10 | 4.0 | 1.50 | 2.7 | 6.0 | 776.3 | 2.62 | 94.3 | | 0 |
| | | | | | | | | | |
| EMBODIMENT3 | | | | | | | | | |
| SAMPLE11 | 1 | 0.40 | 2.5 | 2.5 | 584.3 | 1.97 | 94.3 | | 92 |
| SAMPLE12 | 0.7 | 0.40 | 1.8 | 2.5 | 497.9 | 1.68 | 94.3 | | 87 |
| SAMPLE13 | 0.5 | 0.40 | 1.3 | 2.5 | 440.3 | 1.49 | 94.3 | | 67 |
| SAMPLE14 | 0.3 | 0.40 | 0.8 | 2.5 | 382.7 | 1.29 | 94.3 | | 22 |
| | | | | | | | | | |
| EMBODIMENT4 | | | | | | | | | |
| SAMPLE15 | 1 | 0.38 | 2.7 | 1.5 | 1016.3 | 3.43 | 94.3 | T-TYPE | 100 |
| SAMPLE16 | 1 | 0.38 | 2.7 | 2.5 | 726.3 | 2.46 | 94.3 | T-TYPE | 100 |
| SAMPLE17 | 1 | 0.38 | 2.7 | 1.5 | 776.9 | 2.62 | 94.3 | | 92 |
| SAMPLE18 | 1 | 0.38 | 2.7 | 2.5 | 584.3 | 1.97 | 94.3 | | 76 |

METAL MEMBER TO BE CAST-WRAPPED

TECHNICAL FIELD

The present invention relates to a metal member to be cast-wrapped by a metal cast article, a method for manufacturing the metal member to be cast-wrapped and a metal cast article including the metal member to be cast-wrapped.

BACKGROUND ART

A light metal member to be cast-wrapped by a light metal cast article, which has a rough uneven outer surface formed by shot-blast blowing hard coarse pyramidal or sharp grains against the outer surface, has been known (Japanese Laid-open Patent Publication Hei 10-94867).

In the above-mentioned light metal member to be cast-wrapped, an outer surface of the hard coarse grain is required to have a sharp edge, in order to make the outer surface of the light metal member rough.

When the outer surface of the light metal member to be cast-wrapped is made rough using the hard grains, bottoms of the rough surface are formed in sharp ravines by sharp edges of the hard coarse grains, but tops of the rough surface are not necessarily formed in a sharp peaks. Further, it is required that mean grain size of the hard grains is 70 $\mu$m and distribution of the grain sizes is a nearly a predetermined normal distribution. If velocity of an air jet for blowing the hard coarse grains and ratio of amount of the air jet and amount of the hard coarse grain are not appropriate, a desired rough surface can not be obtained.

Since the above-mentioned hard coarse grain is a high-class corundum particle which is a fragile hard material with broken sharp edge, it is inevitable that the hard coarse grain becomes fine by the shot-blast. Therefore, in order to use the hard coarse grains after the shot-blast repeatedly, it is necessary that the hard coarse grains made fine by the shot-blast are separated and removed continuously to maintain a predetermined distribution of the grain size. This administration of the grain size is complicated.

Projections of a rough surface formed on the light metal member to be cast-wrapped may be melted by large heat capacity of the cast-wrapping light metal and metallurgically combined with the cast-wrapping light metal. However, the metallurgically combined portion is a part of the surface of the light metal member to be cast-wrapped and the projection of the rough surface is tapered, so that mechanical combining force between the light metal member to be cast-wrapped and the cast-wrapping light metal is low. Therefore, when a force for mutually separating the light metal member to be cast-wrapped and the cast-wrapping light metal acts owing to difference of thermal expansion of them, a crack is apt to be produced at a boundary portion between them to remarkably lower heat transfer between them.

DISCLOSURE OF INVENTION

The present invention relates to an improvement of the customary metal member to be cast-wrapped overcoming the above difficulties. The present invention provides a metal member to be cast-wrapped by a metal cast article, wherein the metal member to be cast-wrapped has an irregular uneven surface, a projection is projected from the surface, and a maximum width of the projection at a tip end portion is wider than a maximum width of the projection at a base portion.

When a molten metal is poured to cast-wrap the metal member to be cast-wrapped, the cast wrapping molten metal surrounds the projection of the metal member to be cast-wrapped covering a wide area and the surface of the projection is sufficiently heated by heat of the molten metal to be metallurgically combined with the cast-wrapping metal surely.

Since the maximum width of the projection at the tip end portion is wider than the maximum width of the projection at the base portion, the projection is combined with the cast-wrapping metal mechanically strongly by hook effect, so that a crack is hardly produced at a boundary portion between them and a high heat transfer is obtained.

Since the metal member to be cast-wrapped has an irregular uneven surface, surface area of the projection of the metal member to be cast-wrapped is increased to promote the metallurgical combination and the metal member to be cast-wrapped is combined with the cast-wrapping metal more strongly.

At least a part of the tip end portion of the projection may be formed in a tapering sharp shape. Since the tip end portion of the projection is sharp, heat mass is little and the projection can be metallurgically combined with the cast-wrapping metal perfectly.

The metal member to be cast-wrapped may be an extruded member having smooth grooves directed in a direction of extruding and irregular projections disposed between the grooves, and the irregular projections may be formed when the metal member is extruded. The metal member to be cast-wrapped having projections can be mass-produced efficiently and at a low cost.

And, mechanical combination by a hook effect of the club-shaped portion and metallurgical combination by molten metal storing effect of the undercut shape are promoted.

A side of the irregular projection near an extrusion starting end may be wide and high and a side of the irregular projection near an extrusion completing end may be narrow and low. Drag resistance of the metal member to be cast-wrapped against the cast-wrapping metal in the extruding direction becomes larger remarkably.

The metal member to be cast-wrapped may be a hollow cylindrical body. A sleeve of an internal combustion engine, for example, can be manufactured easily and very strong tight combination of a block and the sleeve can be obtained.

The present invention provides a cylindrical metal member to be cast-wrapped, wherein the cylindrical metal member has an outer surface formed with projections, the projections are arranged axially in rows and arranged circumferentially at regular intervals through grooves, and tip end portions of the projections are bent laterally.

The tapered tip end of the projection of the cylindrical metal member to be cast-wrapped is metallurgically combined with the cast-wrapping metal sufficiently, and the whole projection is heated by molten metal storage effect of the undercut portion to promote the metallurgical combination. Further, movement of the cast-wrapping metal in radial and circumferential directions is restrained by a bent portion having the undercut portion to strengthen combining force and adhering force owing to mechanical combination.

Further, the present invention provides a cylindrical metal member to be cast-wrapped, wherein the cylindrical metal member has an outer surface formed with projections, the projections are arranged axially in rows and arranged circumferentially at regular intervals through grooves, and tip end portions of the projections are bent in axial direction.

Adhesion and combining forces in an axial direction of the cylinder are improved to restrain mutual slipping in the axial direction between the cylindrical metal member to be cast-wrapped and the cast-wrapping metal and fix them to each other firmly. Owing to improvement of adhesion, heat transfer, cooling performance and knocking resistance are improved.

Since the projections formed on the outer surface of the cylindrical metal member to be cast-wrapped are arranged axially in rows and arranged circumferentially at regular intervals through grooves, adhesion and combining forces in an axial direction of the cylinder are improved by the rows of the projections and the grooves intervening between the rows of the projections, mutual slipping in the axial direction between the cylindrical metal member to be cast-wrapped and the cast-wrapping metal is restrained, and they are fixed to each other firmly. Therefore, owing to improvement of adhesion, heat transfer, cooling performance and knocking resistance are improved. The groove between the rows of projections improves running of molten metal so that quality of the cast product is improved.

The projections formed on the outer surface of the metal member to be cast-wrapped may be arranged axially at irregular intervals and may not be aligned circumferentially. Mutual slipping between the cylindrical metal to be cast-wrapped and the cast-wrapping metal in circumferential direction, as well as in an axial direction, is restrained, adhesion and combining forces between the cylindrical metal to be cast-wrapped and the cast-wrapping metal are improved more, and cooling performance and knocking resistance are further improved.

The present invention provides further, a method for manufacturing a cylindrical metal member to be cast-wrapped by a metal cast article having an outer surface with projections, comprising: preparing a die having an inner peripheral surface formed with longitudinal grooves of depth H and width W, wherein the relation between a maximum depth $H_{MAX}$ and a minimum width $W_{MIN}$ of the groove being set as $H_{MAX}/W_{MIN} \geqq 1.5$; inserting a cylindrical metal material in the die; and hot-extruding the cylindrical metal material to obtain the cylindrical metal member to be cast-wrapped having an outer surface with projections.

According to this method, projections can be formed on the outer surface of the cylindrical metal member to be cast-wrapped simultaneously with extrusion of the cylindrical metal member, and a working step such as a shot blast is unnecessary, therefore cost-reduction is possible.

By setting the relation between the maximum depth $H_{MAX}$ and the minimum width $W_{MIN}$ of the groove as $H_{MAX}/W_{MIN} \geqq 1.5$, the aforementioned cylindrical metal member to be cast-wrapped having high adhesion and combining force can be manufactured easily.

The minimum width $W_{MIN}$ of the groove may be set as $W_{MIN} \leqq 1.3$ mm. Many more portions bent in an axial direction can be produced on the outer surface of the cylindrical metal member to be cast-wrapped.

The relation between a minimum inner diameter d and a total inner peripheral length L of a cross-section of the die may be set as $L/d \cdot \pi \geqq 1.5$. The portions bent in an axial direction can be produced on the outer surface of the cylindrical metal member to be cast-wrapped more surely.

The metal member to be cast-wrapped may be made in a hollow cylindrical body. When the metal member to be cast-wrapped is applied to a sleeve of an internal combustion engine, combination and adhesion between a block and the sleeve and cooling nature are improved so that an internal combustion engine of high reliability can be obtained.

BRIEF DESCRIPTION OF DRAWINGS

FIG. 5 is a table showing data of samples in various embodiments;

BEST MODE FOR CARRYING OUT THE INVENTION

Hereinafter, embodiments of the present invention will be described with reference to FIGS. 1 to 16.

Figures 1A, 1B, 1C, 1D, 1E, 1F, 1G:
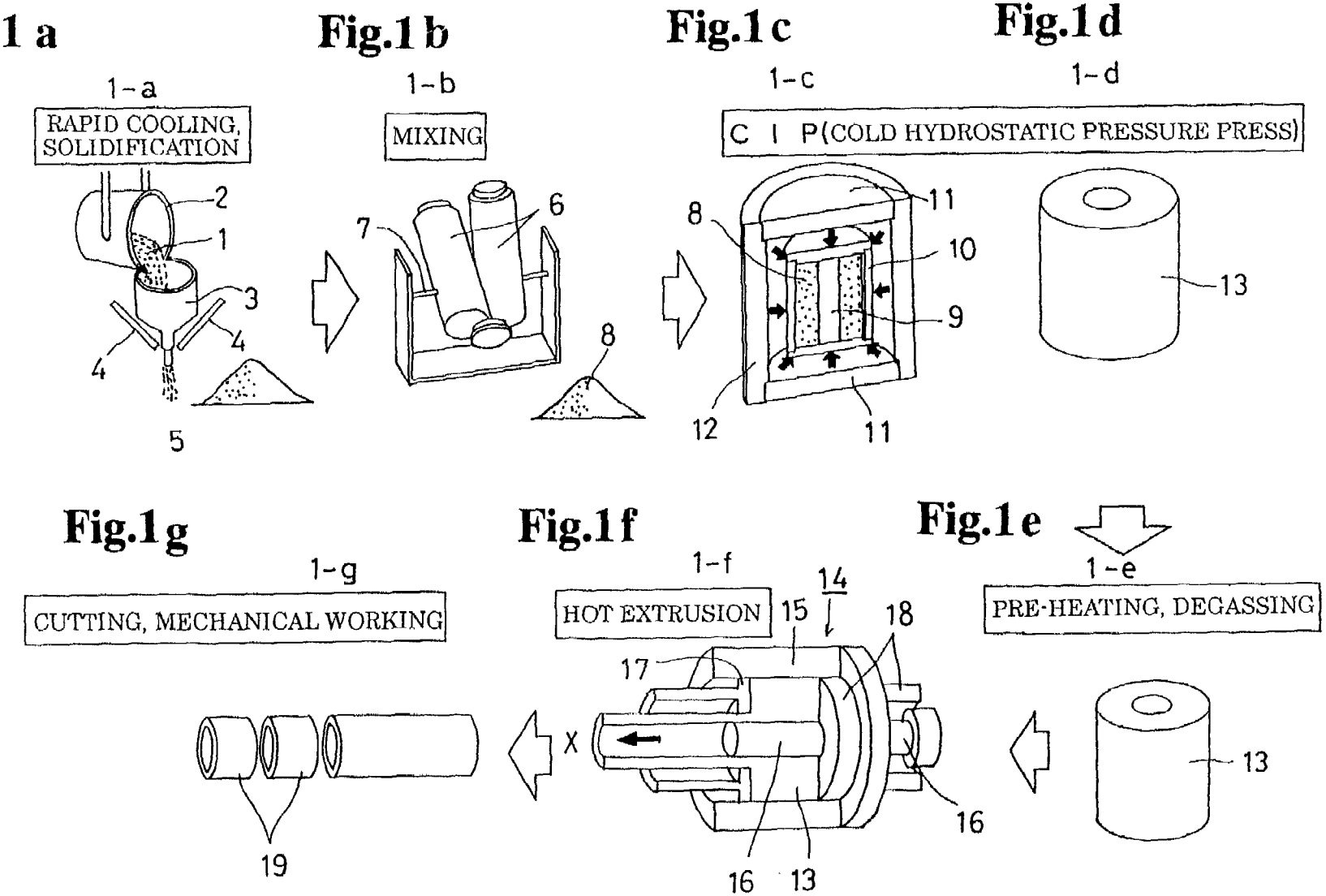
FIGS. 1*a* to 1*g* are explanatory views showing an outline of a method for manufacturing a metal member to be cast-wrapped according to the present invention.

As shown in FIG. 1*a*, molten light alloy 1 containing Al-73%, Si-17%, Fe-5%, Cu-3.5%, Mg-1% and Mn-0.5% (weight %) is charged in a crucible 3 from a pot 2. The molten light alloy drops through an opening provided at a bottom of the crucible. At that time, the molten light alloy becomes fine particles and is rapidly cooled by air or inert gas blown at a high speed from nozzles 4 surrounding the opening, and matrix sub-/per-eutectic aluminum silicon alloy powder 5 is formed (atomizing process).

The matrix sub-/per-eutectic aluminum silicon alloy powder 5 is charged into a mixing vessel 6 together with alumina powder giving abrasion resistance and graphite powder giving self-lubricating nature (FIG. 1*b*). Then, the mixing vessel 6 is closed tight and rotated about a horizontal axis 7 so that the powder is mixed uniformly and billet raw material powder 8 is obtained.

As shown in FIG. 1*c*, the billet raw material powder 8 is charged into a cylindrical rubber bag 10 in which a core 9 having a diameter corresponding to a diameter of a cylinder bore of an internal combustion engine is disposed. The cylindrical rubber bag 10 is housed in a cylindrical pressure vessel 12 having upper and lower lids 11. A liquid such as water is charged in the cylindrical pressure vessel 12 and given pressure of 1.6 GPa to preparatively form a hollow cylindrical billet 13 (FIG. 1*d*) having a uniform density distribution and a density ratio of about 70% (cold hydrostatic pressure forming process).

The hollow cylindrical billet 3 is put in a heating furnace (not shown) and preheated and degassed under nitrogen atmospheric gas (FIG. 1*e*). Then, the hollow cylindrical billet 13 is charged in a container 15 of a hot extrusion apparatus 14 shown in FIG. 1*f*. In the container 15, a mandrel 16 is inserted in a central hole of the hollow cylindrical billet 13. The mandrel 16 is fixed so that a front end of the mandrel 16 is positioned on an extrusion side of a die 17 fixed to the container 15. A front end of a main ram 18 is touched to a back side of the hollow cylindrical billet 13 so that the hollow cylindrical billet 13 is extruded when the main ram 18 moves in a extruding direction X. The extruded hollow cylindrical billet 13 is cut by mechanical work to obtain sleeves 19 of predetermined length (FIG. 1*g*).

Figure 2:
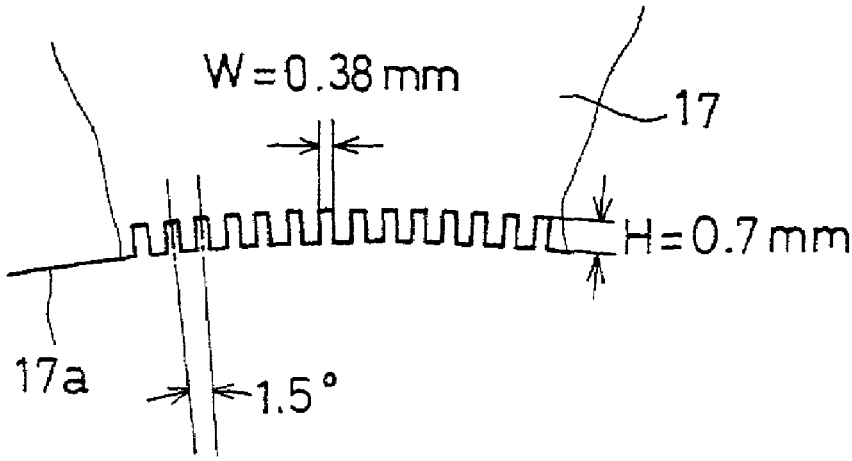
FIG. 2 is an enlarged front view of an essential part of a die used in the manufacturing method.
Figure 3:
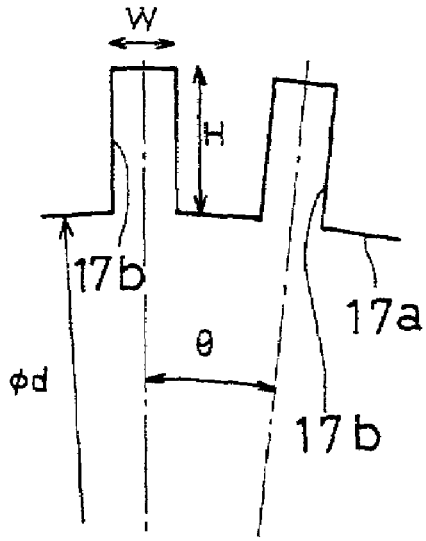
FIG. 3 is a further enlarged front view of an essential part of FIG. 2.

As shown in FIGS. 2 and 3, the die 17 has a circular opening 17*a* having an inner diameter of 94.3 mm, and on the peripheral surface of the opening 17*a* are formed grooves 17*b* of width W and depth H arranged circumferentially uniformly.

As shown in FIG. 5, in an embodiment 1 including samples 1 to 5, all samples have the same groove width W of 0.38 mm and the same groove span (center angle) of 1.50 but have different respective groove heights of 1 mm, 0.7 mm, 0.5 mm, 0.3 mm and 0.2 mm. In the samples 1 and 2 having H/W more than 1.5, tears are produced on projecting lines of the sleeve 19 and irregular rugged lines 20 are formed as shown in FIGS. 5 to 9, 10 to 14 and 15 to 16.

If peripheral length of the groove 17*b* is long, the hollow cylindrical billet 13 is subjected to a large resistance owing to contact with the grooves 17*b* of the die 17 when the billet 13 passes through the grooves 17*b*, so that the above-mentioned tears are produced.

The "tear producing rate" in FIG. 5 means a ratio of a number of the projecting line on which irregular rugged lines are formed by the tear to the total number of the projecting lines on the sleeve 19. In the samples 1 and 2, the tear producing rate is more than 70% and good, therefore H/W more than 1.9 is desirable.

Figure 9:
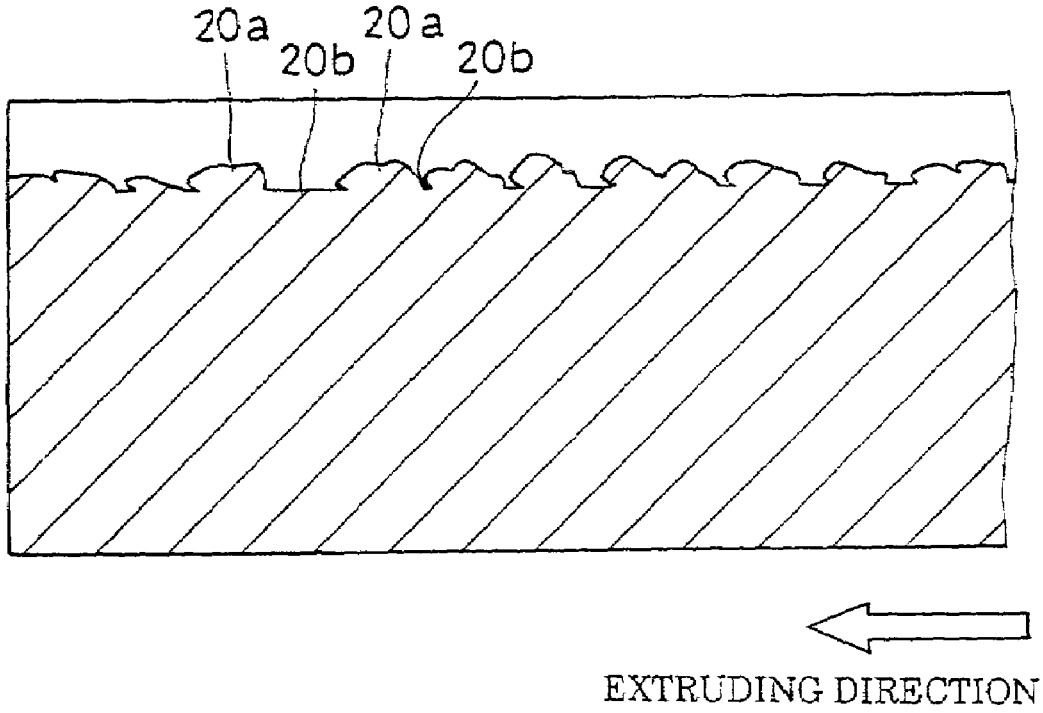
FIG. 9 is an enlarged longitudinal sectional view of an essential part of FIG. 9.
Figure 10:
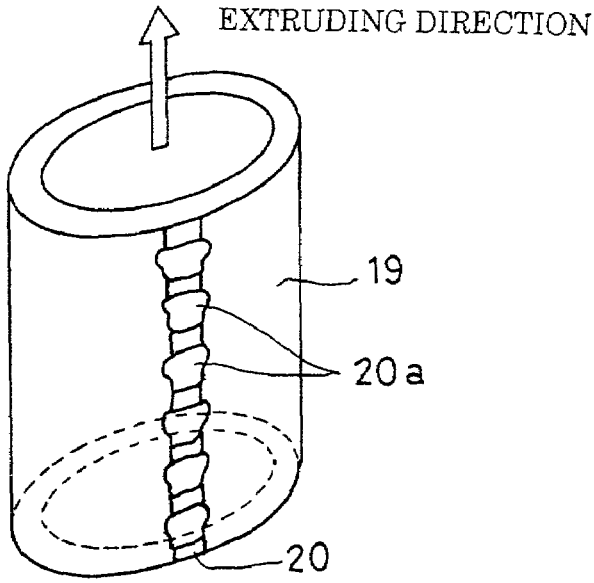
FIG. 10 is a perspective view of the sleeve showing only one of the rugged lines formed on the outer surface schematically and in magnification.
Figure 11:
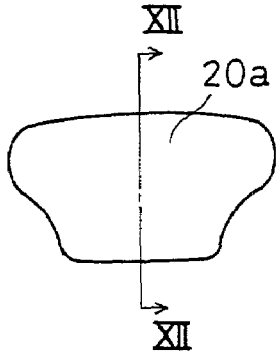
FIG. 11 is an enlarged plan view of the rugged line of FIG. 10.

In the rugged line 20 shown in FIGS. 6 to 9, wide and high portions 20*a* and narrow and low portions 20*h* are arranged irregularly in direction of extrusion, and in the wide and high portion 20*a*, a tip end portion is wider than a base portion near a surface of a groove 21 of the sleeve 19 (the base portion is constricted as shown in FIGS. 10 and 11). Further, the surface of the wide and high portions 20*a* is formed in an irregular rugged surface. Therefore, the sleeve 19 and a cylinder block cast-wrapping the sleeve 19 are mechanically combined strongly.

Since at least a part of the tip end of the wide and high portion 20*a* of the rugged line 20 is formed in a sharp shape, heat of the cast-wrapping molten metal for the cylinder block is added to the sharp tip end of the portion 20*a* concentrically to melt an oxidized film on the portion 20*a*, so that a sure metallurgical combination cian be obtained.

Figure 12:
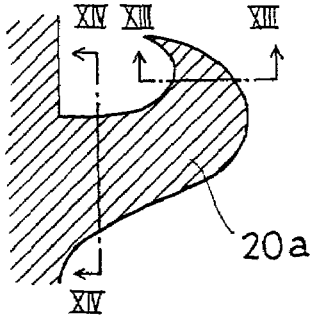
FIG. 12 is a longitudinal sectional view taken along the line XII—XII of FIG. 11.
Figure 13:
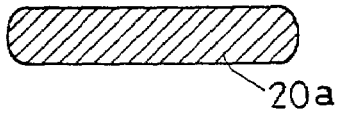
FIG. 13 is a cross-sectional view taken along the line XIII—XIII of FIG. 12.
Figure 14:
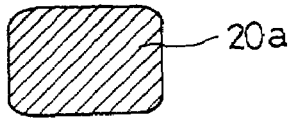
FIG. 14 is a cross-sectional view taken along the line XIV—XIV of FIG. 12.
Figure 15:
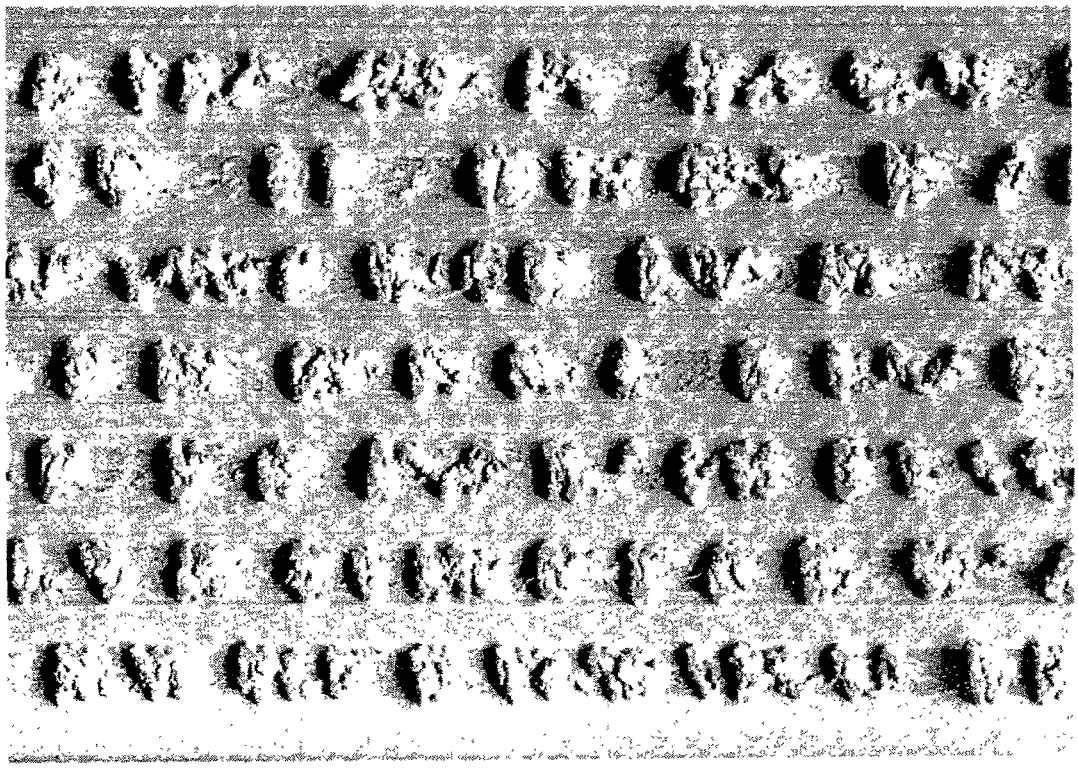
FIG. 15 is a figure of an essential part of the sleeve shown in FIG. 6.
Figure 16:
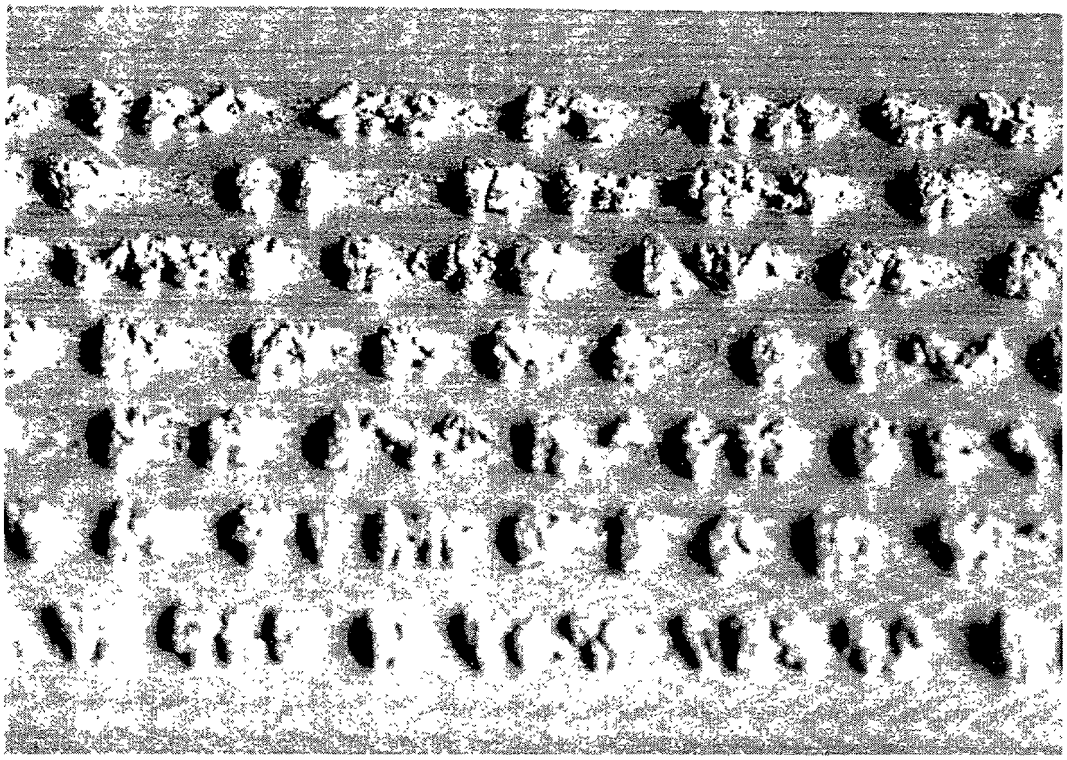
FIG. 16 is a figure of an essential part of the sleeve shown in FIG. 7.

Each of the wide and high portion 20*a* of the rugged line 20 has a side near an extrusion starting end that is wider and higher and another side near an extrusion completing end that is narrower and lower, and ar end surface of the wide and high portion 20*a* at the extrusion starting end is inclined in the extrusion direction from the base portion toward the tip end portion (FIG. 9 and FIG. 12). Therefore, when the sleeve 19 cast-wrapped by the cylinder block is forced in the extrusion direction, a large resistance is exhibited.

In the samples 1, 2, since the sleeve 19 has the irregular rugged lines 20 on the outer surface, heat of molten metal for the cylinder block cast-wrapping the sleeve 19 is rapidly transferred to an irregular rugged surface of the rugged line 20, so that the rugged surface is melted at a sufficiently high temperature for metallurgical combination. Moreover, since the tip end of the wide and high portion 20*a* of the rugged line 20 is bent like a hook and the bottom part of the portion 20*a* is made wide (see FIG. 12), the sleeve 19 and the cylinder block is strongly combined mechanically, so that the sleeve 19, which comes into sliding contact with a piston and is subjected to various forces, can be held by the cylinder block stably and firmly.

Even it a thermal stress is generated so as to separate the sleeve 19 and the cylinder block owing to a difference of thermal expansion between the sleeve 19 and the cylinder block, the sleeve 19 and the cylinder block is kept in a strongly combined state and there is no fear that a gap is generated between them.

Since the sleeve 19 and the cylinder block are combined tight without a gap, heat of the sleeve 19, which is contacted with a combustion chamber and heated, escapes through the cylinder block having a high heat transfer coefficient, and the sleeve 19 is kept at a suitable temperature. Therefore, knocking performance is improved, load of the cooling system is lowered, and space between neighboring sleeves 19 can be shortened to miniaturize the internal combustion engine.

In case that the sub-/per-eutecticaluminumsilicon alloy sleeve 19 having projections of undercut shapes formed on the outer peripheral surface during extrusion of the sleeve 19 is cast-wrapped by a cylinder block (not shown) produced by high pressure die casting, following features can be obtained.

When the outer peripheral surface of the sleeve 19 is cast-wrapped by the cylinder block, molten metal for the cylinder block surrounds entirely the projecting portion 20*a* of undercut shape by injection pressure of the die casting. At that time, a strong oxidized film on the tip end of the projecting portion 20*a* having small heat-mass is locally melted by thermal energy of the molten metal. Thus, both a mechanical combination and a metallurgical combination are carried out and high adhesion combining force can be obtained.

Since different kinds of combinations can be carried out simultaneously in the injection process of the cylinder block, gaps produced between the cylinder block and the outer peripheral surface of the sleeve are few. Therefore, the piston is cooled effectively, knocking performance is improved, and heat generated in the combustion chamber can be led to cooling system effectively. Since the sleeve is fixed to the cylinder block firmly, oil-up is reduced and exhaust emission (hydrocarbon) can be reduced.

If the cylinder block is subjected to age heat treatment in consideration of thermal history, gaps between the sleeve and the cylinder block are very few and therefore combination of the sleeve and the cylinder, block is strong, so that deformation of an inner peripheral surface of the bore in course of operation is reduced, and as the result, oil consumption and blow-by performance are improved.

In the samples 3, 4, 5 of the table shown in FIG. 5, H/W are less than 1.5 and as tear result, the tear producing rates are low.

In an embodiment 2 in the table of FIG. 5, the same hollow cylindrical billet 13 as the billet in the embodiment 1 is used, and H and W of the samples 6–10 are selected so that H/W of all of the samples are 2.7 (more than 1.5). In the samples 6, 7, 8 and 9, since the width of the groove 17*b* of the die 17 is smaller than 1.3 mm, the tear producing rate is more than 70%. Accordingly, the samples 6, 7, 8 and 9 can be put to practical use.

But, in the sample 10, since the width of the groove, 17*b* of the die 17 is 1.5 mm more than 1.3 mm, the tear is not produced. Accordingly the sleeve 19 extruded from the die 17 has the same cross-section as that of the die 17 and the sleeve 19 cannot be put to practical use.

In an embodiment 3 in the table of FIG. 5, powder having a composition (Al-58.5%, Si-25%, Cu-4.5%, Mg-1.5%, $Al_2O_3$-10% and Gr (graphite particle)–0.5%) other than that in the embodiment 1 is shaped at a pressure of 1.6 GPa by cold hydrostatic pressure press to obtain the hollow cylindrical billet 13. The hollow cylindrical billet 13 is hot extruded at a state heated to 450° C. The above powder is made in such a manner that after matrix sub-/per-eutectic aluminum silicon alloy powder is shaped by atomizing process similarly to the embodiment 1, $Al_2O_3$ and Gr are added.

In the samples 11, 12 of the embodiment 3, since H/W is more than 1.5, width W of the groove 17*b* of the die 17 is less than 1.3 and peripheral length ratio $L/d \cdot \pi$ is more than 1.5, tear producing rate is 92% or 87% and good rugged line 20 is formed.

However, in the samples 13, 14, since the peripheral length ratio $L/d \cdot \pi$ is less than 1.5, tear producing rate is low though tear is produced partly, so that these samples can not be put to practical use.

Figure 4:
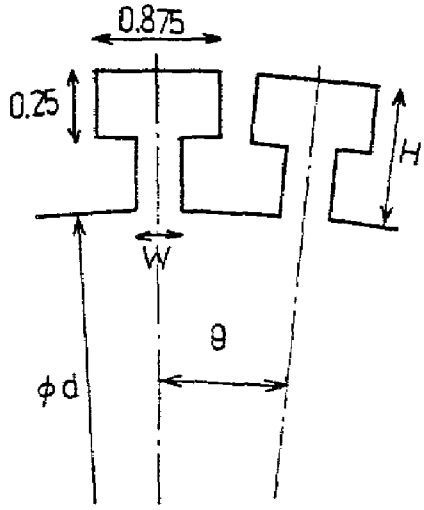
FIG. 4 is a partial enlarged front view of an other die.
Figure 6:
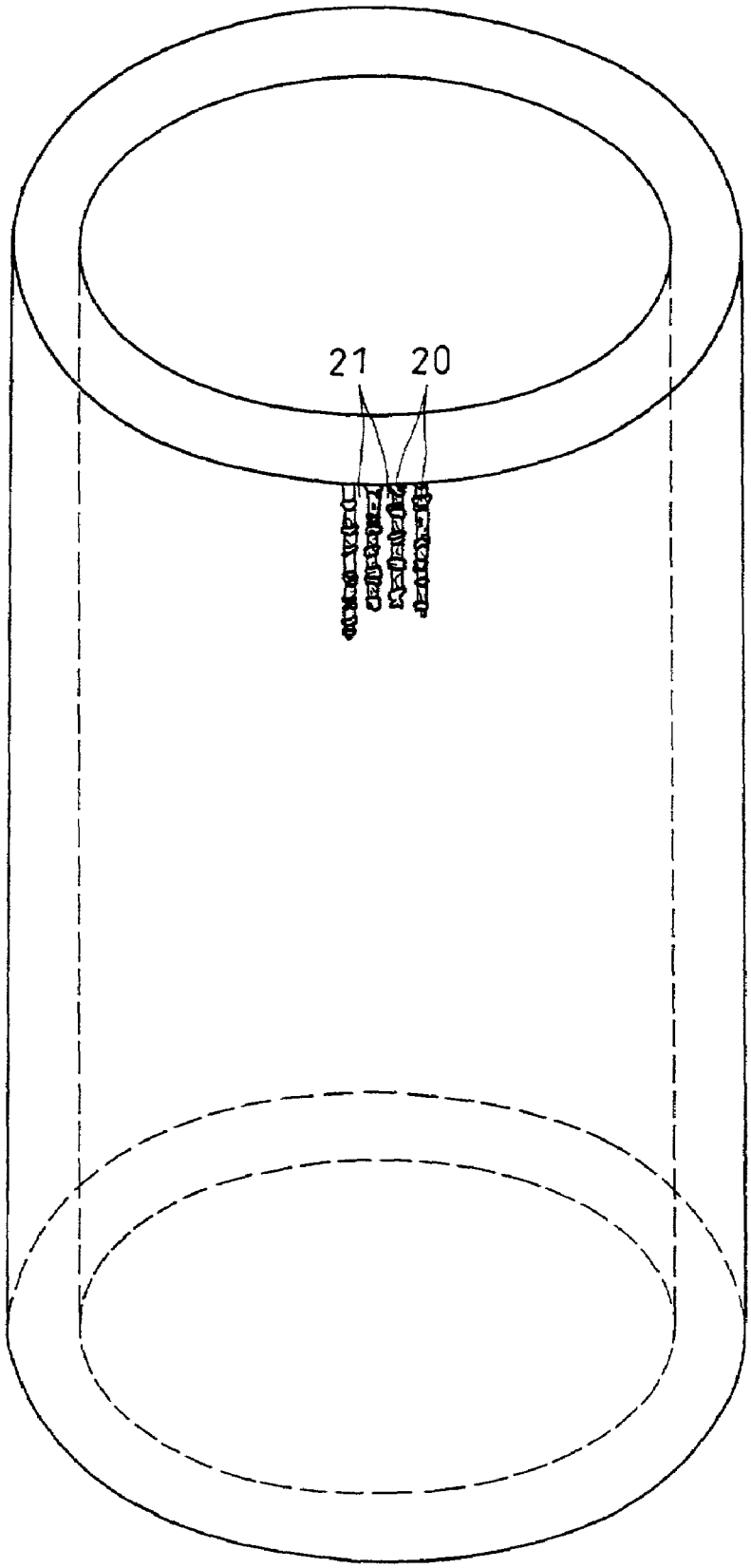
FIG. 6 is a perspective view of a sleeve in which only rugged lines formed on the outer surface is shown schematically and in magnification.
Figure 7:
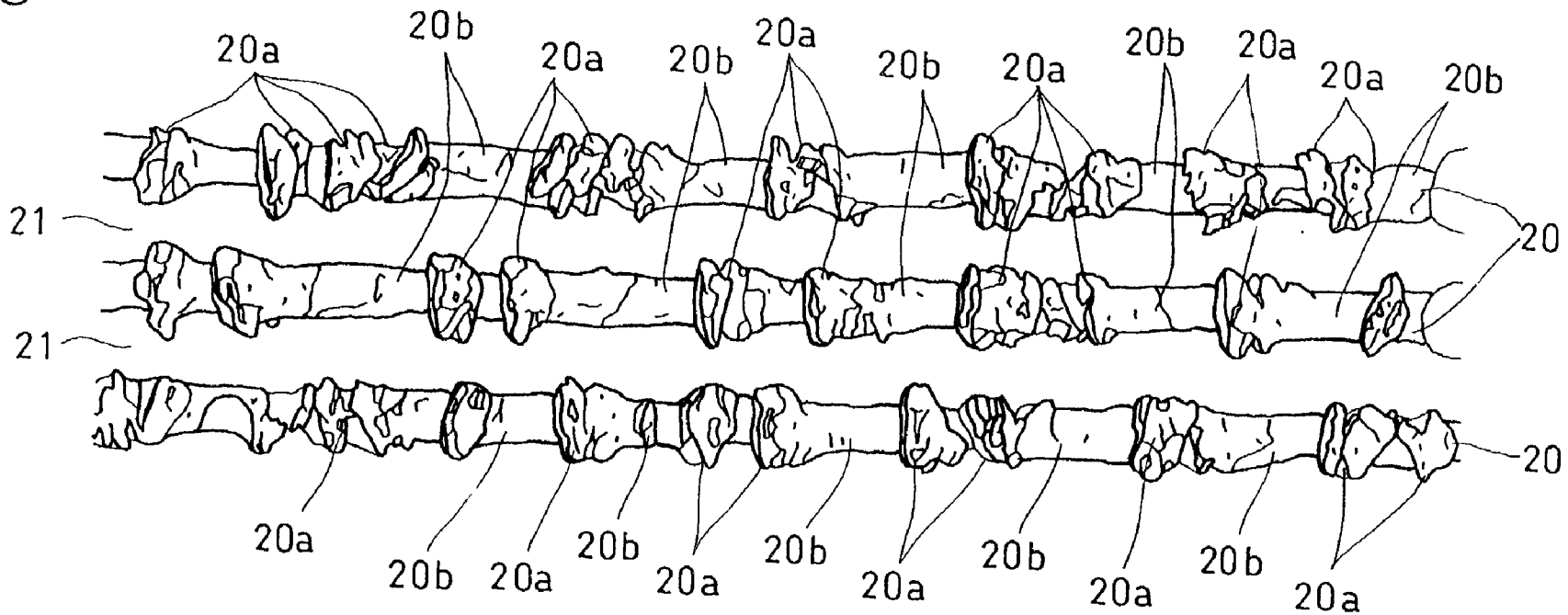
FIG. 7 is a partial enlarged plan view of the rugged lines formed on the outer surface of the sleeve.
Figure 8:
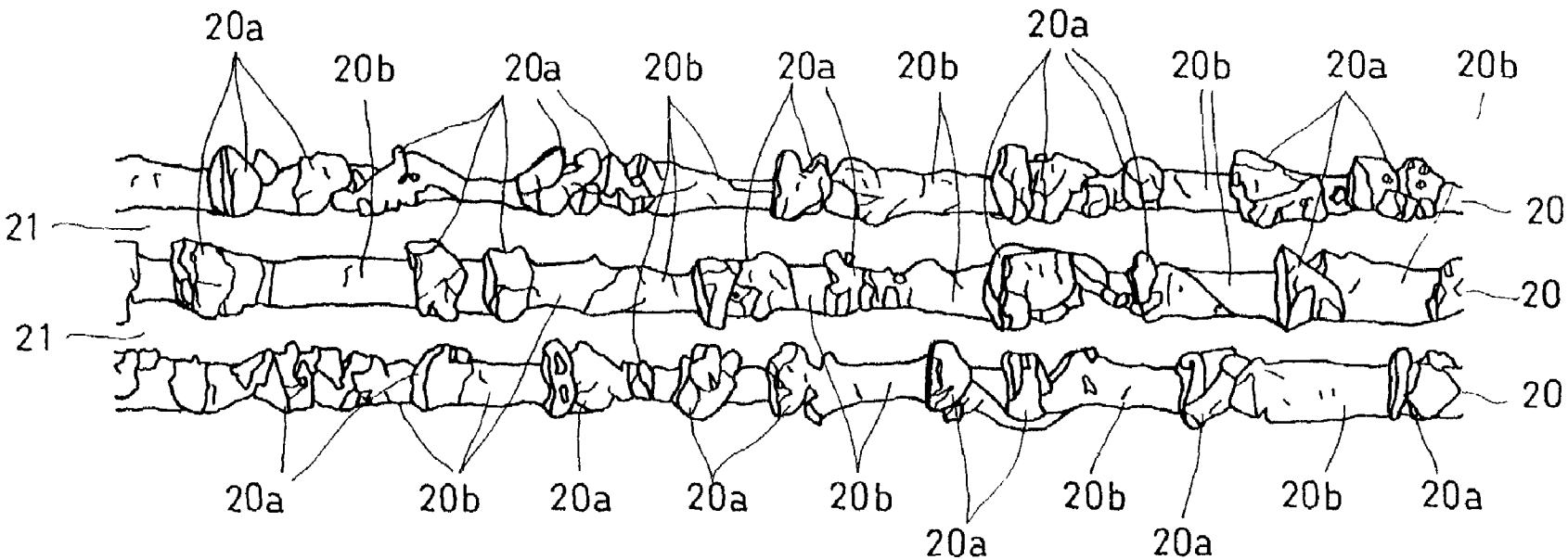
FIG. 8 is a partial enlarged perspective view of the rugged lines formed on the outer surface of the sleeve.

In an embodiment 4 in the table of FIG. 5, the same hollow cylindrical billet 13 as that in the embodiment 3 is used. In each of the samples 15, 16, the groove 17*b* of the die 17 is formed in T-shape as shown in FIG. 4, inner peripheral length of the die 17 is necessarily long, correspondingly the peripheral length ratio $L/d \cdot \pi$ is remarkably larger than 1.5 and therefore tear producing rate is 100%.

In the samples 17, 16, peripheral length ratio is more than 1.5 but smaller compared with the samples 15, 16, therefore tear producing rate is high but does not reach 100%.

In the above-mentioned embodiments, the metal member to be cast-wrapped is a sinter-extruded article (sleeve 19), but it may be an ordinary extruded article, a forged article or a cast article.

INDUSTRIAL APPLICABILITY

The present invention can be applied to a metal member to be cast-wrapped by a metal cast article such as a sleeve of an internal combustion engine to be cast-wrapped by a cylinder block or the like.

The invention claimed is:

1. A metal member to be cast-wrapped by a metal cast article, wherein said metal member to be cast-wrapped has an extruded roughened surface portion resulting from tearing of a surface portion of a metal material by hot extrusion through a die to produce a plurality of irregularly formed projections which extend outwardly from said surface, and wherein a maximum width of said projections at a tip end portion thereof is wider than a maximum width of the projections at a base portion thereof.

2. A metal member to be cast-wrapped as claimed in claim 1, wherein at least a part of said tip end portion of each of said projections is formed in a tapering sharp sectional shape.

3. A metal member to be cast-wrapped as claimed in claim 1 or 2, wherein said extruded, roughened surface is arranged as elongated mutually spaced surface portions extending parallel to a direction of extruding of the member and wherein elongated smooth, unroughened surface portions are disposed between, and extend parallel to, said roughened surface portions.

4. A metal member to be cast-wrapped as claimed in claim 3, wherein a side of each of said irregularly formed projections facing an extrusion starting end is wide and high, and a side of each of said irregularly formed projections facing an extrusion completing end is narrow and low.

5. A metal member to be cast-wrapped as claimed in claim 1 or 2, wherein said metal member to be cast-wrapped is a hollow cylindrical body.

6. A metal member to be cast-wrapped by a metal cast article as claimed in claim 1, wherein said metal member is a cylindrical member that has an outer surface having at least one extruded roughened surface portion resulting from tearing of at least one surface portion of the cylindrical metal material by hot extrusion through a die to produce said irregularly formed projections extending outwardly from said surface, said projections of a roughened surface portion being arranged in a row extending parallel to an axis of the cylindrical member and at intervals spaced circumferentially about the cylindrical member.

7. A metal member to be cast-wrapped by a metal cast article as claimed in claim 6, wherein each of said projection-defining tears has a tip end portion bent laterally.

8. A metal member to be cast-wrapped by a metal cast article as claimed in claim 6, wherein unroughened grooves are provided between circumferentially adjacent rows of projection-defining tears.

9. A metal member to be cast-wrapped by a metal cast article as claimed in claim 6, wherein said roughened surface contains rows of projections resulting from said tearing, said rows being arranged at regular intervals about the circumference of said cylindrical member.

10. A metal member to be cast-wrapped by a metal cast article as claimed in claim 6, wherein said projection-defining tears are arranged at irregular intervals in said rows and generally out of circumferential alignment.

11. A metal member to be cast-wrapped by a metal cast article as claimed in claim 6, wherein said cylindrical member is hollow.

* * * * *